US007251895B2

(12) United States Patent
Kurtz

(10) Patent No.: US 7,251,895 B2
(45) Date of Patent: Aug. 7, 2007

(54) MOLDING AND NAME PLATE REMOVAL TOOL

(75) Inventor: Scotty R. Kurtz, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/294,096

(22) Filed: Dec. 5, 2005

(65) Prior Publication Data

US 2007/0050990 A1 Mar. 8, 2007

Related U.S. Application Data

(63) Continuation-in-part of application No. 11/222,267, filed on Sep. 8, 2005.

(51) Int. Cl.
*B26B 3/00* (2006.01)

(52) U.S. Cl. ..... 30/169; 30/171; 30/329; 30/342; 15/236.01

(58) Field of Classification Search ..... 30/169, 30/171, 227, 168, 329, 342, 344, 337; 15/236.01, 15/263.02, 93.1; 7/103; 294/54.5, 59, 49, 294/57

See application file for complete search history.

(56) References Cited

U.S. PATENT DOCUMENTS 2,766,471 A * 10/1956 McKenzie ..... 15/105
4,010,542 A * 3/1977 Richardson et al. ..... 30/164.9
4,700,420 A * 10/1987 Belanger ..... 7/114
5,140,752 A 8/1992 Kasprzak
5,208,984 A * 5/1993 Negus ..... 30/169
5,219,378 A * 6/1993 Arnold ..... 30/169
5,235,751 A 8/1993 Landgraf
5,301,429 A 4/1994 Bundy
5,480,507 A * 1/1996 Arnold ..... 156/344
5,640,772 A * 6/1997 Roeker et al. ..... 30/169
5,822,825 A * 10/1998 West ..... 15/236.02
6,862,968 B1 * 3/2005 Ogston ..... 83/13

OTHER PUBLICATIONS

Snap-On, Material Removal Tool, No. MR2000.
Steck Manufacturing Company, Inc., E-Z Strip Molding Tool, Part No. 59890, p. 9.
3M Company, Part No. 051135-08978, Side Molding and Emblem Removal Tool.
Invention Disclosure Agreement, Donna Pitts, Putty Knife for Air Chisel Gun, Feb. 16, 1986.
Invention Disclosure Agreement, Donald R. Hughes, Air Chisel Blade for Removing Wide Body Moldings, Nov. 17, 1986.
Invention Disclosure Agreement, Ulys Layne d/b/a J & L Marketing, Tool to Remove Body Side Molding, Mar. 10, 1995.
Invention Disclosure Agreement, Paul Collett, Knife to Remove Side Molding and Emblems, Dec. 1, 1997.
Invention Disclosure Agreement, Rob Boyce, Windshield and Body Molding Removal, Apr. 14, 2000.
Invention Disclosure Agreement, Jaime Gallardo, Adhesive Moulding and Name Plate Removal Tool, Oct. 8, 2004.

* cited by examiner

*Primary Examiner*—Boyer D. Ashley
*Assistant Examiner*—Omar Flores Sánchez
(74) *Attorney, Agent, or Firm*—Banner & Witcoff, Ltd.

(57) ABSTRACT

A multifunctional molding name plate removal tool includes a blade attached to a blade retainer having a drive arm and a threaded handle attached thereto. The threaded handle may be removed in order to enable a pneumatic tool to drive the tool.

9 Claims, 4 Drawing Sheets

4.
5.
60°
10
12
14
16
18
20
21
22
24
26
28
40
42
44
46
50
52
54
56
58
60
62
64
66

MOLDING AND NAME PLATE REMOVAL TOOL

CROSS REFERENCE TO RELATED APPLICATION

This is a Continuation-In-Part Application of Ser. No. 11/222,267, filed Sep. 8, 2005, which is incorporated herewith by reference and for which priority is claimed.

BACKGROUND OF THE INVENTION

In a principal aspect the present invention relates to a tool useful for the removal of molding and/or name plates from various items such as motor vehicles in order to effect repair and/or replacement.

When repairing the body of a damaged motor vehicle, it is often necessary to remove the name plates or the molding which is attached to the body sheet metal typically by means of some adhesive. The methodology for removal of such items has been dependent upon the use of chisel-type devices. Such devices are exemplified by a tool offered by Steck Manufacturing Co., Product No. 59890 and 3M Company, Product No. 051135-08978. These tools typically include a rod with one end configured to receive a pneumatic drive tool and the opposite end attached to a blade. In use, the tool is driven by the pneumatic driving tool and the blade is caused to undercut the molding or name plate from a vehicle body. These devices may include a blade which is permanently affixed to a rod, such as with the 3M tool, or a blade which may be removable from the tool. U.S. Pat. No. 5,301,429 for a Tool for Removing Moldings and the Like also discloses a tool of this general type.

Such devices have been found to be useful and accepted somewhat in the relevant trades. However, certain aspects of the use of such tools are undesirable. For example, it may not be desirable to use a pneumatic driving mechanism for such a tool, particularly where the name plate or decorative item to be removed is small or requires a delicate hand operation to effect removal. On the other hand, to provide a separate tool which may be hand operated and another tool which may be pneumatically operated calls for extra tools. Thus, there has developed the need for an improved, multifunctional molding and name plate removal tool.

SUMMARY OF THE INVENTION

Briefly, the present invention comprises a molding and name plate removal tool which is convertible between a hand operated tool and a pneumatically operated tool. The tool is comprised of a generally rectangular blade which is comprised of a thin spring steel material and includes a leading edge that is shaped in the manner which enables it to be inserted under a name plate or a piece of molding adhered to a vehicle by adhesive without damaging the underlying paint, or at least minimizing any such damage. The blade is a separate element which is attached to an elongate driving rod that has a special shape or configuration enabling the drive rod to be impacted axially from its drive rod end by means of a pneumatic driver or alternatively to receive a handle so that the tool may be manually operated or driven. The drive rod further includes a blade attachment arrangement which enables the blade to be tightly adhered to the opposite end of the drive rod. The drive rod end of the drive rod includes a flared section which is externally threaded so that a handle with a counterbore and internal threads may be screwed onto the drive rod end of the drive rod. Thus, the tool may be converted between a mode of operation dependent upon manual manipulation and engagement using the removable handle or, alternatively, by means of a pneumatic driver which engages the drive rod end when the manual handle has been removed.

Thus, it is an object of the invention to provide an improved, multifunctional molding and name plate removal tool which is convertible between a manually operational configuration and a pneumatically driven configuration.

Another object of the invention is to provide a molding and name plate removal tool wherein the blade of the tool may be easily replaced.

A further object of the invention is to provide a molding and name plate removal tool which includes a blade that is configured to minimize any potential for damage of the underlying substrate upon which the molding or name plate is affixed.

Another object of the invention is to provide an inexpensive, yet rugged, easily used molding and name plate removal tool.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figures 1, 2, 3, 4, 5:
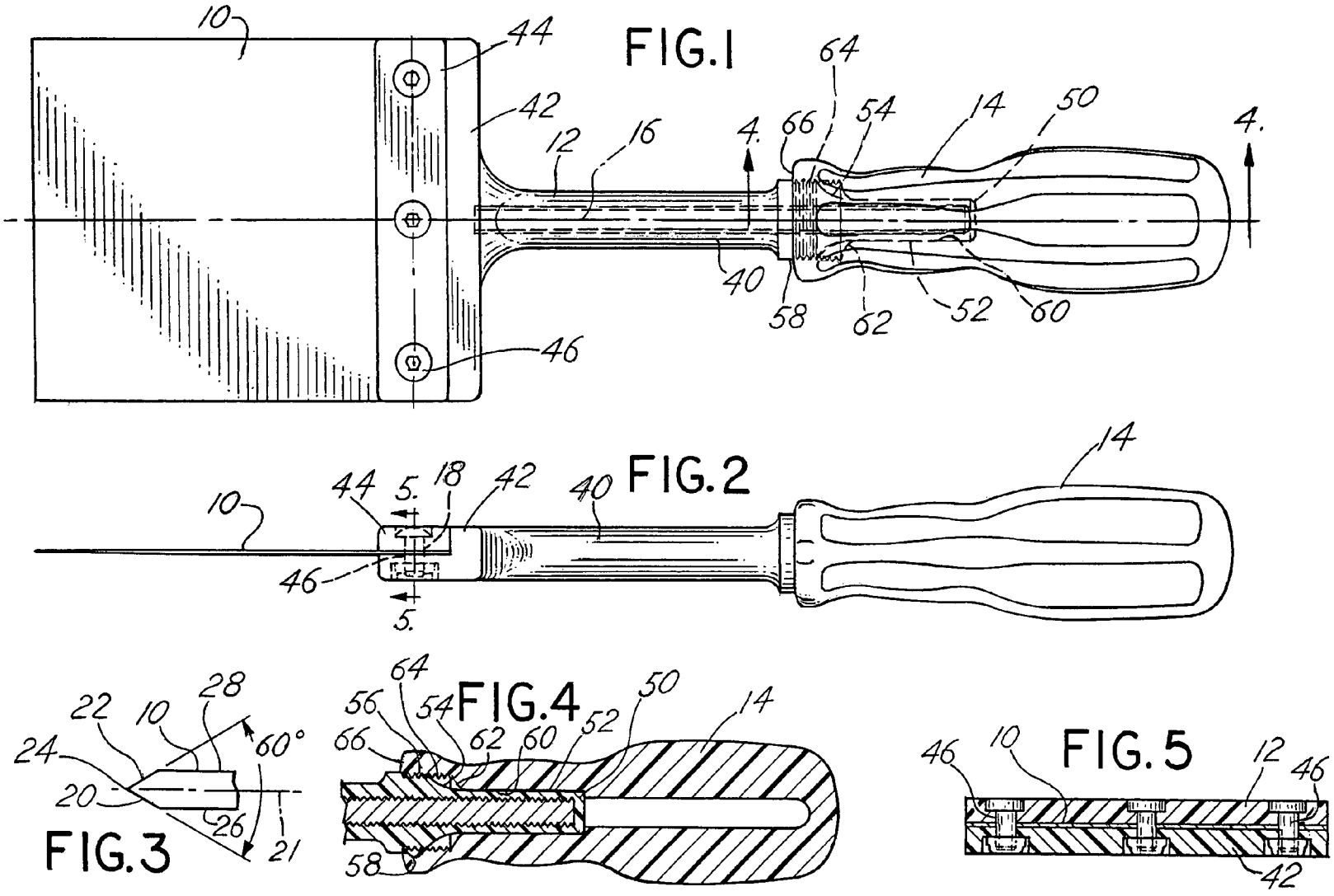
FIG. 1 is a top plan view of an embodiment of the tool of the invention.
FIG. 2 is a side elevation of the tool of FIG. 1.
FIG. 3 is an enlarged detail and side view of the end of the blade of the tool of FIG. 2.
FIG. 4 is a cross sectional view taken along the line 4-4 in FIG. 1.
FIG. 5 is a cross sectional view of the tool of FIG. 2 taken along the line 5-5 in FIG. 2.

Referring to the figures, the tool of the invention is comprised of three separate component parts. The tool thus includes a blade 10, a blade retainer 12 and a threaded manual handle 14. The blade 10 is a generally rectangular spring steel blade having a thickness in the range of 0.015±0.005 inches and a dimension in the range typically, in the longitudinal direction of a longitudinal axis 16, of 3-6 inches and a transverse dimension in the range of 2-5 inches. The blade 10 includes first, second and third passages 18 at the end which serve to connect blade 10 to the retainer 12 and further includes a blade edge 24, for example, as shown in FIG. 3 comprised of first and second converging, planar faces 20 and 22 which define an included angle of 60°±15°. The preferred angle of convergence is in the range of 60°±5°. A functional reason for the configuration of the leading edge 24 of the blade 10 is to provide a symmetrical edge 24 where the surfaces 20 and 22 generally converge to a center line axis 21. The leading edge 24, thus, is a symmetrical convergence of the surfaces 20 and 22 and this promotes and permits the placement of either of the flat planar surfaces 26 or 28 of blade 10 adjacent or against a vehicle body surface, for example. In other words, the tool may be oriented with either surface 26 or 28 adjacent the body surface of a vehicle. The tool is thus reversible. Further, the leading edge 24, being symmetrical, tends to preclude any gouging of the surface against which the blade 10 may be placed. Thus, the configuration of the leading edge 24 of the blade 10 constitutes a functional feature of the invention.

The blade 10 is aligned with the longitudinal centerline axis 16 of a drive rod arm 40 of the blade retainer 12. That is, the blade retainer 12 includes a drive head assembly 42 with an elongate drive rod arm 40 centrally located and extending along the axis 16. The head assembly 42 includes a blade retention bar 44 held in position by nut and bolt assemblies 46 that fit through passages or openings 45 in the retention bar 44, blade 10 and the transverse drive head assembly 42. Again, note that all of the component parts are arranged so as to be symmetrical about the center line axis 16. The drive rod arm 40 terminates at a driven end 50 which is a generally cylindrical shaped drive rod section 52 that is connected with a smoothly joined arcuate section 54 that, in turn, connects to a next adjacent, greater diameter, externally threaded section 56 that, in turn, connects to a circumferential rib or an abutment 58 at the end of the section 56. The end of the drive rod arm 40 is thus compatible with a manual handle 14.

That is, the manual handle 14 includes a counterbore 60 with a flared abutment section 62, an internally threaded section 64 and an outside end abutment 66. The depth of the counter bore 60 is slightly greater than the longitudinal length of the drive rod extreme end section 52. The flared section 62 of the handle 14 is designed to be spaced from the flared section 54 of the drive rod arm. The outer abutment end 66 of the handle 14 will engage the abutment 58 of the drive rod. The internal threads 64, of course, will engage the external threads 56. Thus, the handle 14 may be threaded onto the drive rod arm 40. However, if the handle 14 is pushed during operation of the tool because of the abutting surfaces, such as the surfaces of abutment 58, 66, the threads 64 of the handle 14 will not be stripped. Thus, the configuration of the counterbore 60 and the depth of the counterbore 60 as well as the various abutting surfaces all function to preserve the integrity of the threads 64 and the compatible threads 56 on the drive rod arm 50. Again, the tool is generally symmetrical about the centerline axis 16 and the symmetry persists along the entire length of the retainer and the handle 14. In practice in the manufacture of the tool, the blade retainer 12 is fabricated from a glass filled nylon material with a center metal rod axially aligned therewith providing for additional structural integrity.

Figure 6:
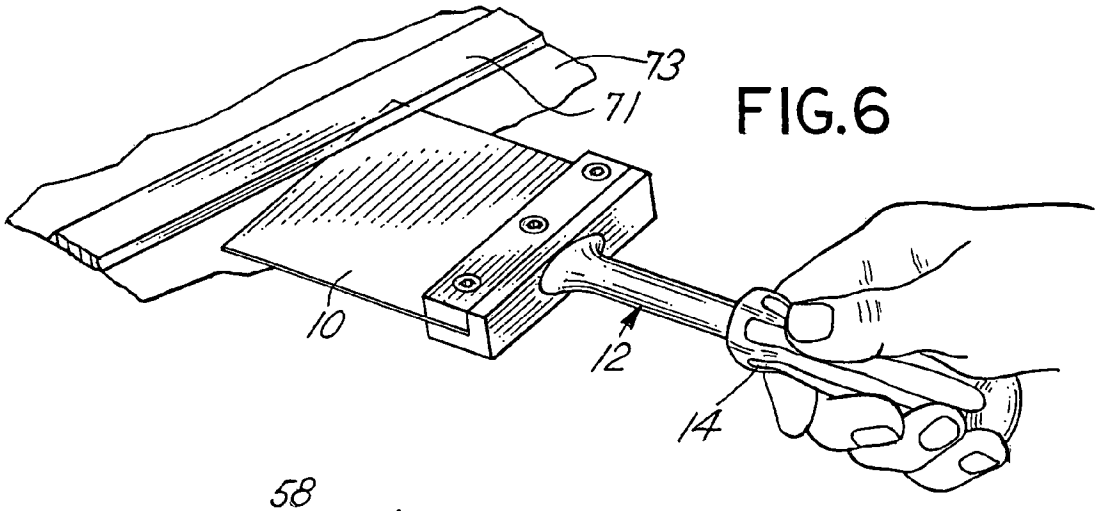
FIG. 6 is an isometric view of the tool of FIG. 1 illustrating the manner of manual operation.
Figure 7:
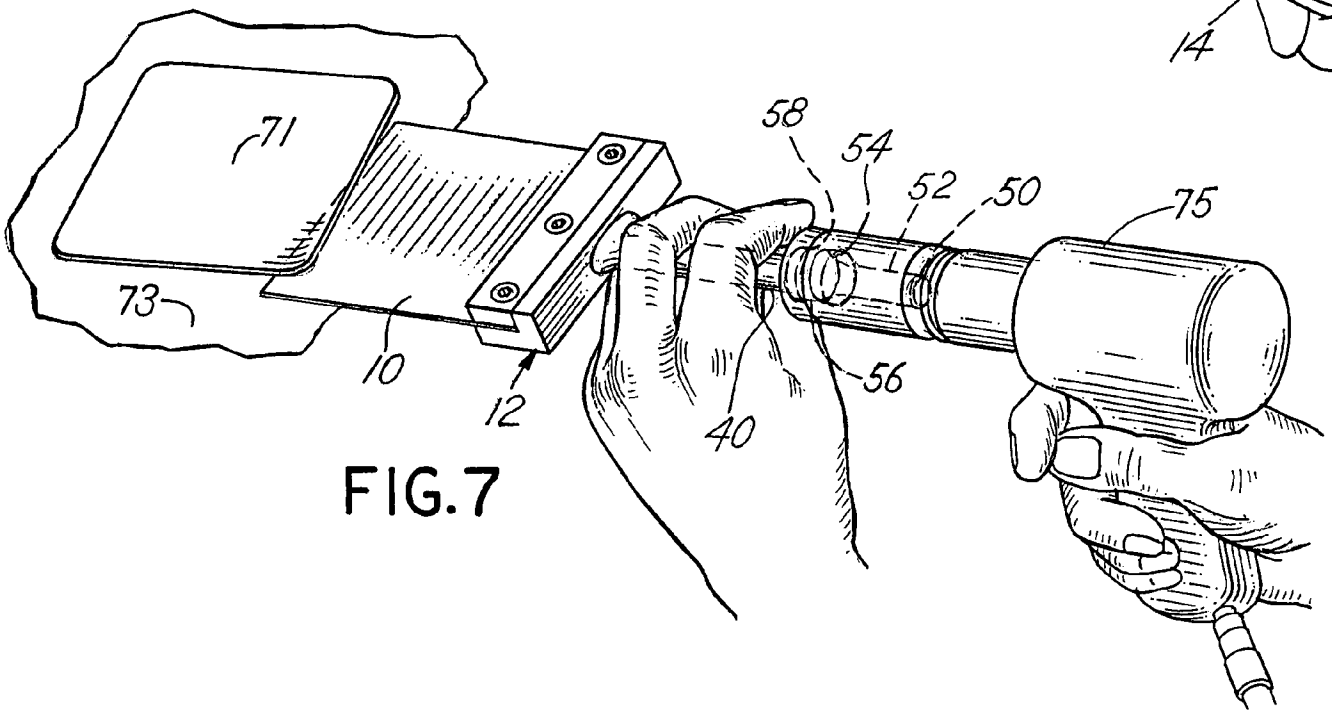
FIG. 7 is an isometric view of the tool of FIG. 1 configured for use in combination with the pneumatic driving tool.
Figure 8:
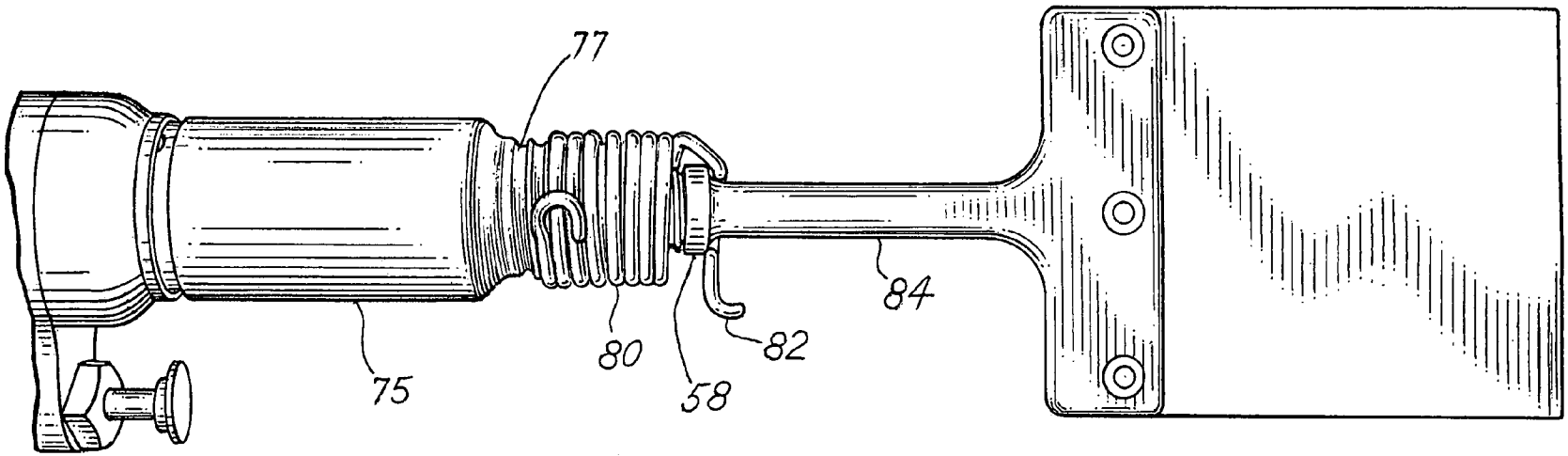
FIG. 8 is an isometric view of the arrangement of the tool in combination with a pneumatic driving tool having a retainer spring.

FIGS. 6, 7 and 8 illustrate various ways to use the tool. In FIG. 6 the handle 14 is placed on the arm 40 and the combination may then be manually manipulated beneath or between a molding or name plate 71 adhered to a vehicle body surface 73. FIG. 7 depicts the same arm 40 with the handle 14 removed and a pneumatic tool 75 fitted over the driven end 52 of the retainer blade member 12. Referring to FIG. 8, a retainer spring 80 may be threaded onto the end 77 of pneumatic driving tool 75. The retainer spring 80 includes a depending arm 82 which is positioned to retain the tool in combination with the pneumatic driving tool 75 by being engageable with the circumferential rib or abutment 58. Thus, as the tool moves axially back and forth in response to driving tool 75, the depending arm 82 insures the combination remains connected. The depending arm 82 fits into the region 84 of a reduced diameter of rod arm 40 to insure maintenance of the assembly.

Figure 1B:
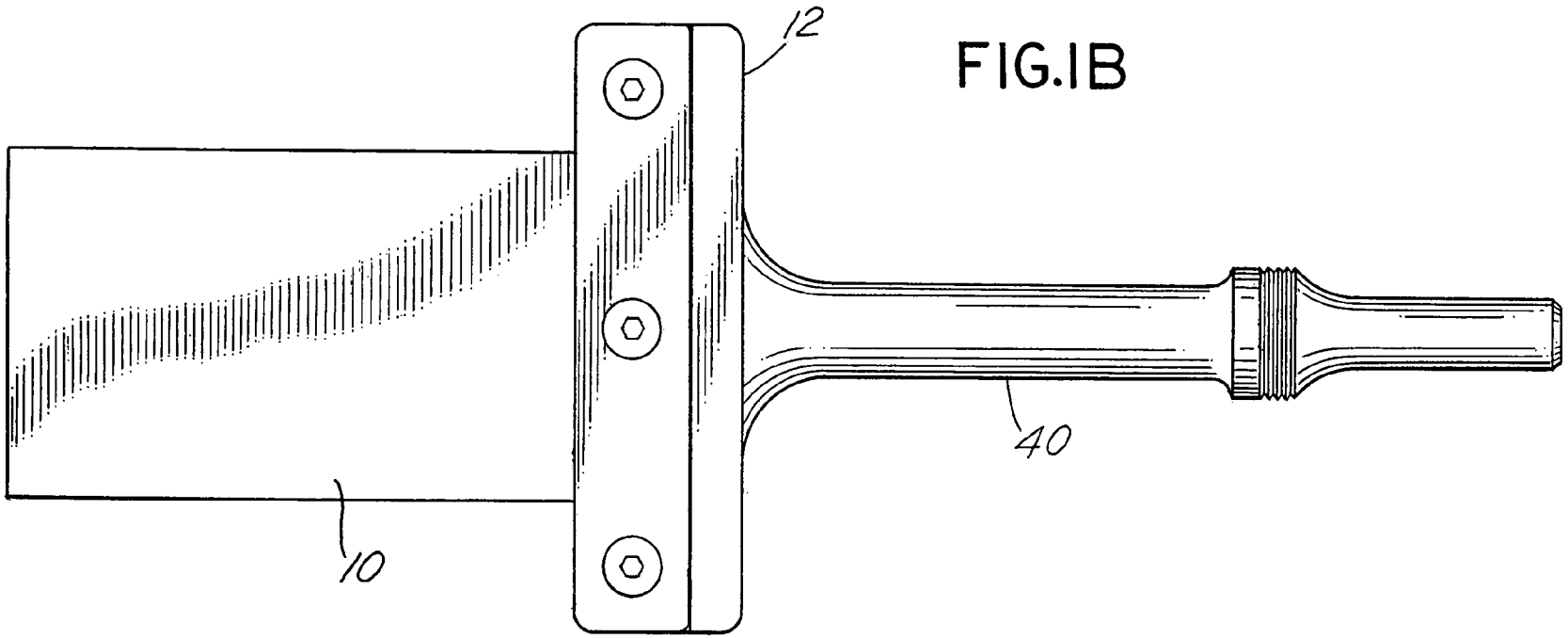
FIG. 1B is a top plan view of an alternative embodiment.

The tool of the invention utilizes threads to engage the handle onto the blade retainer drive rod arm 40. However, other attachment means may be utilized. Also, the fasteners 46 as previously described which hold the blade 10 in position may be removed. The embodiment utilizes three fasteners 46. However, different numbers of fasteners 46 may be utilized. Also, the fasteners may be permanently fixed in passages 18. However, removable fasteners are preferred. A preferred dimension of the blade is approximately 3.5 inches in width and approximately 4 inches in length in the axial direction. Typically, the blade 10 will be comprised of a spring steel such as a 1075 spring steel material. As depicted in FIG. 1B, the blade 10 may be narrow for use in limited access situations. Because the blade 10 is removable, it may be replaced and various sizes may be employed with the retainer 12. Variations of the construction or tool may be incorporated without departing from the spirit and scope thereof. Dimensionally, variations may be effected. Additionally, the drive rod arm 40 may be angled slightly rather than totally symmetrical. Thus, the invention is to be limited only by the following claims and equivalents thereof.

What is claimed is:

1. A multifunctional molding and name plate removal tool kit comprising, in combination:

a generally rectangular thin blade having a longitudinal axis extending between a forward sharpened end and an opposite attachment end, said forward sharpened end including a blade edge formed by first and second converging surfaces generally defining an included angle;

a blade retainer including an elongate drive rod arm having a blade retaining assembly at one end and a unitary drive head assembly integral with said drive rod arm at the opposite end, said blade retaining assembly including a cross bar blade attachment member generally transverse to the drive rod arm, said cross blade attachment member comprising a slot for receipt of said thin blade, and a plurality of fasteners for holding said thin blade in said slot, said drive head assembly including an extreme end cylindrical drive rod section having a first diameter, a flared arcuate connecting section (54) joined from the drive rod section to an adjacent handle attachment section having a releasable threaded drive head assembly attachment configuration for engaging a handle having a diameter greater than the drive rod section, a next adjacent rib section, said next adjacent rib section having a diameter greater than the maximum diameter of the handle attachment section; and a separable handle with a counterbore for receipt of the drive rod section, and a threaded handle attachment configuration for releasably engaging the handle attachment section, said handle further including a end rib section engagement surface for engaging the next adjacent rib section to limit axial movement of the handle and a flared section (62) spaced from the flared arcuate section (54) to protect the threaded releasable attachment configurations by spacing the flared section (62) of the handle from the flared section (54) of the drive head assembly whereby the handle may be unthreaded and removed from the handle attachment section and said drive rod section may be driven by a tool without engaging the threaded drive head assembly attachment configuration.

2. The tool kit of claim 1 wherein the fasteners for holding the blade are removable to enable blade removal.

3. The tool kit of claim 1 wherein the handle and drive rod arm are coaxial.

4. The tool kit of claim 1 wherein the included angle of the blade is 60°±15°.

5. The tool kit of claim 1 wherein the included angle of the blade is 60°±10° and the blade thickness is in the range of 0.015±0.005 inches and said blade comprises a 1075 spring steel material.

6. The tool kit of claim 1 wherein the blade is at least about 3.5 inches in transverse dimension.

7. The tool kit of claim 1 further including a reduced radial dimension section of the drive rod arm intermediate the rib section and the blade retaining assembly.

8. The tool kit of claim 1 further including a pneumatic driving tool for engaging the drive rod section of said drive head assembly.

9. The tool kit of claim 8 further including a retainer attachable to the pneumatic driving tool and including an arm for engaging said rib section to limit axial movement of the drive head assembly relative to the pneumatic driving tool.

* * * * *